United States Patent [19]

Melde-Tuczai et al.

[11] Patent Number: 4,753,199

[45] Date of Patent: Jun. 28, 1988

[54] INTERNAL COMBUSTION ENGINE

[75] Inventors: Helmut Melde-Tuczai; Johann Aigner; Othmar Skatsche, all of Graz, Austria

[73] Assignee: Avl Gesellschaft für Verbrennungskraftmaschinen und Messtechnik m.b.H. Prof. Dr. Dr.h.c. Hans List, Graz, Austria

[21] Appl. No.: 937,534

[22] Filed: Dec. 3, 1986

[30] Foreign Application Priority Data

Dec. 9, 1985 [AT] Austria ..... 3567/85

[51] Int. Cl.[4] ..... F01L 1/02

[52] U.S. Cl. ..... 123/90.31

[58] Field of Search ..... 123/90.27, 90.31, 195 R, 123/192 B, 192 R

[56] References Cited

U.S. PATENT DOCUMENTS

| | | | |
|---|---|---|---|
| 809,791 | 1/1906 | Eisenhuth | 123/90.31 |
| 3,402,707 | 9/1968 | Heron | 123/195 R |
| 3,418,993 | 12/1968 | Scheiterlein et al. | 123/90.27 |
| 3,990,325 | 11/1976 | Bueren | 123/192 B |
| 4,095,579 | 6/1978 | Isawa et al. | 123/192 B |
| 4,300,493 | 11/1981 | Berti | 123/192 B |
| 4,395,980 | 8/1983 | Tominaga et al. | 123/90.27 |

FOREIGN PATENT DOCUMENTS

| | | | |
|---|---|---|---|
| 1210245 | 10/1970 | United Kingdom | 123/192 B |

*Primary Examiner*—Willis R. Wolfe, Jr.
*Assistant Examiner*—M. Macy
*Attorney, Agent, or Firm*—Watson, Cole, Grindle & Watson

[57] ABSTRACT

In an internal combustion engine with cylinders inline and an overhead camshaft for actuation of the intake and exhaust valves, the camshaft is driven from the crankshaft by means of a driving gear and an intermediate shaft, the driving gear being rigidly connected to an outer cheek of the crankshaft. With this arrangement the distance between the crankshaft bearings remains unchanged and a minimum overall length of the engine is achieved. At the same time a speed reduction gear may be located anywhere between the crankshaft and the camshaft.

10 Claims, 3 Drawing Sheets

INTERNAL COMBUSTION ENGINE

BACKGROUND OF THE INVENTION

This invention relates to an internal combustion engine with cylinders arranged in-line and an overhead camshaft for actuation of the intake and exhaust valves of the engine, the camshaft being driven from the crankshaft by means of a driving gear and further gear elements.

DESCRIPTION OF THE PRIOR ART

In conventional internal combustion engines of this type the width of the driving gear or pinion on the crankshaft adds to the overall length of the engine. The drive of an overhead camshaft is usually effected by a toothed belt drive whose pinion at the front end of the crankshaft is positioned outside of the crankshaft bearings. If a vibration damper is included, it is placed even further in front of this pinion. In addition, other accessory drives, e.g., drives for the oil pump and the fuel injection pump or the ignition distributor, operate via additional gears or chaindrives whose pinions are placed on the crankshaft outside the crankshaft bearings. In another known type of arrangement the pinion is mounted within the crankshaft bearings and outside of the crank cheek. In this instance, the distance between the bearing and the respective crank must be larger than that for the other cranks, however.

The disadvantage of all of the above engine designs is the unduly large axial length, which is particularly aggravating in engines comprising torsional vibration dampers.

SUMMARY OF THE INVENTION

It is an object of the present invention to avoid such disadvantages and to configure the camshaft drive such that it will not add to the overall length of the engine while permitting the addition of a speed reduction gear between crankshaft and camshaft.

According to the invention this is achieved by placing the driving gear on an outer cheek of the crankshaft between the planes bounding this outer cheek and running normal to the crankshaft axis, and by driving the camshaft from an intermediate shaft which in turn is driven, via gear elements, by the driving gear on the outer cheek of the crankshaft. The advantage of this arrangement is that the driving gear on the crankshaft will not increase the overall length of the internal combustion engine. Besides, it will be easily possible to add a speed reduction gear anywhere between the crankshaft and the camshaft, if so desired. The intermediate shaft can be driven from the crankshaft at a 1:1 ratio, for example, and the reduction ratio required may be obtained by an appropriate selection of gears on the intermediate shaft (e.g., a cluster gear) and the camshaft.

This means that the camshaft gear or pinion need not be more than half the size of the crankshaft gear in four-stroke engines, and may be dimensioned smaller than the crankshaft gear in two-stroke engines. In this way not only the overall length but also the height of the engine may be kept very small, especially at the front end. This is of major importance for the future of vehicle construction because of today's tendency towards an ever flatter design of the engine hood in order to reduce drag.

In another variant of an internal combustion engine according to the invention, with a torsional vibration damper on the end of the crankshaft away from the flywheel, the camshaft is driven by a toothed belt whose front boundary does not extend beyond the front boundary plane of the vibration damper, and where the gear elements driving the intermediate shaft are located within the boundary planes of the outer crankshaft cheek on the side of the vibration damper, which are normal to the crankshaft axis. As a result, the belt drive between intermediate shaft and camshaft will not increase the overall length of the engine. On the side of the flywheel the intermediate shaft may carry a drive for the oil pump and the fuel injection pump. In case of a spark ignition engine a distributor would be used instead of a fuel injection pump.

In a further development of the invention the driving gear, preferably a geared wheel or a chain pinion, and the outer cheek of the crankshaft are a one-piece unit. In case of different design and manufacturing requirements this comparatively simple design may be replaced by another variant of the invention, in which the driving gear, preferably a geared wheel or chain pinion, is a separate part that is rigidly connected to the other crankshaft cheek, preferably by shrinking.

DESCRIPTION OF THE DRAWINGS

Following is a more detailed description of the invention as illustrated by the accompanying drawings in which.

DETAILED DESCRIPTION OF PREFERRED EMBODIMENTS

Figure 1:
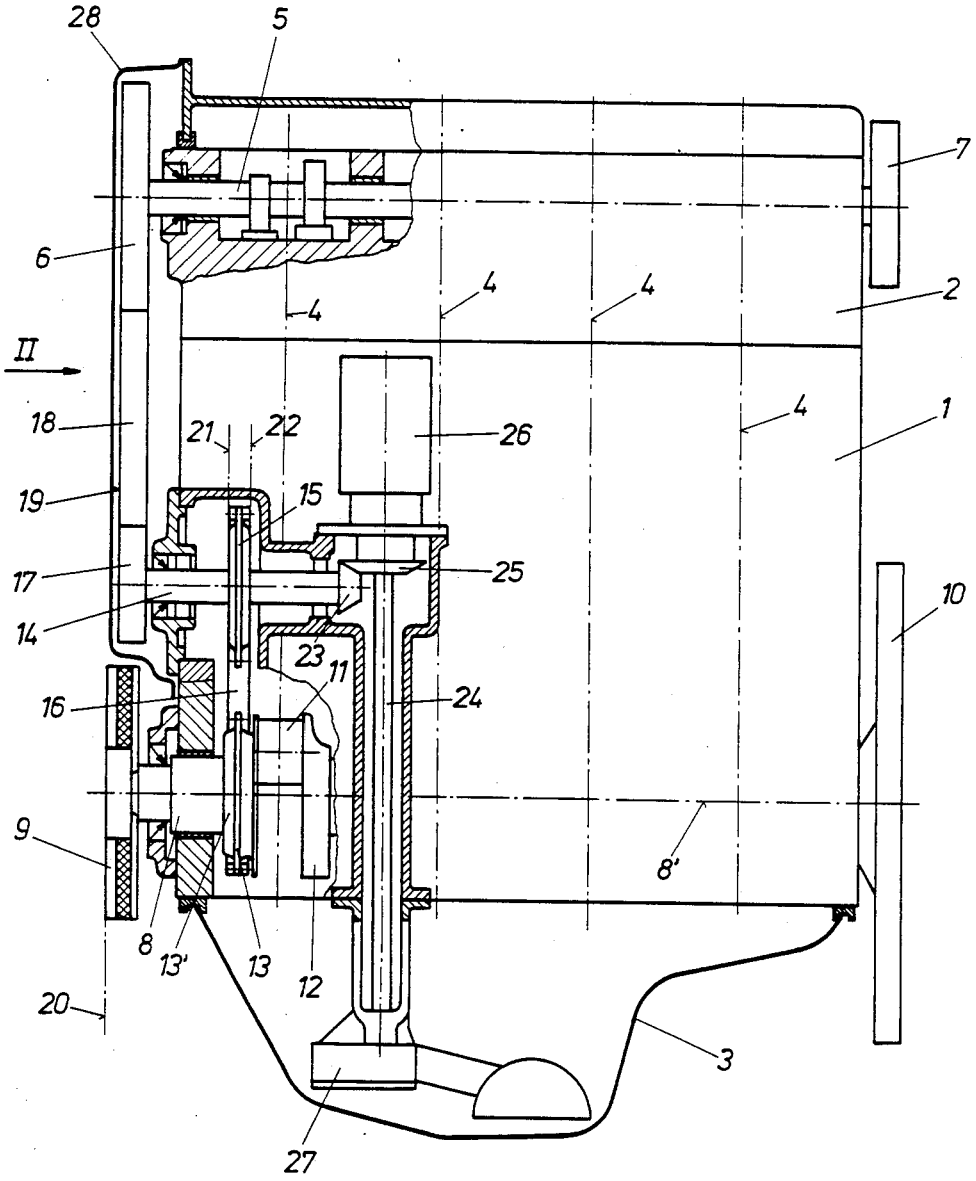
FIG. 1 is a partial longitudinal section along line I—I in FIG. 2.
Figure 2:
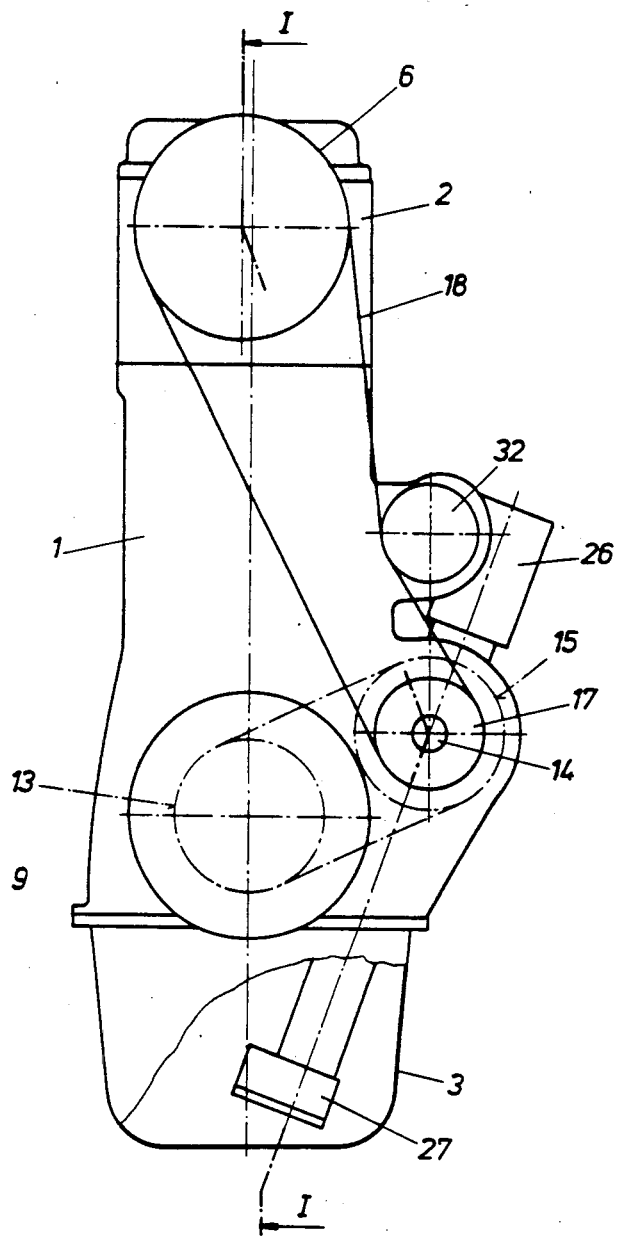
FIG. 2 is a view of an engine in accordance with a preferred embodiment of the present invention as seen in the direction of arrow II in FIG. 1.

The internal combustion engine shown in FIGS. 1 and 2 comprises a cylinder block 1, a cylinder head 2 and an oil-sump 3. The engine has four cylinders whose axes are marked 4. In the cylinder head 2 the camshaft 5 is held, which is driven from a toothed belt pulley 6 at the front end, and which in turn is provided with a belt pulley 7 on the end of the flywheel for driving accessory units not shown in this drawing, such a dynamo and/or a water pump. The crankshaft 8, which is held in the cylinder block and whose axis is marked 8', carries a torsional vibration damper 9 at its front end, and a flywheel 10 at the opposite end. The frontmost crankpin 11 of the crankshaft 8 is located between two crank cheeks, of which the inner cheek 12 is of a conventional kind, and the outer cheek 13' is configured as a chain wheel 13, which is used as a driving gear.

Figure 3:
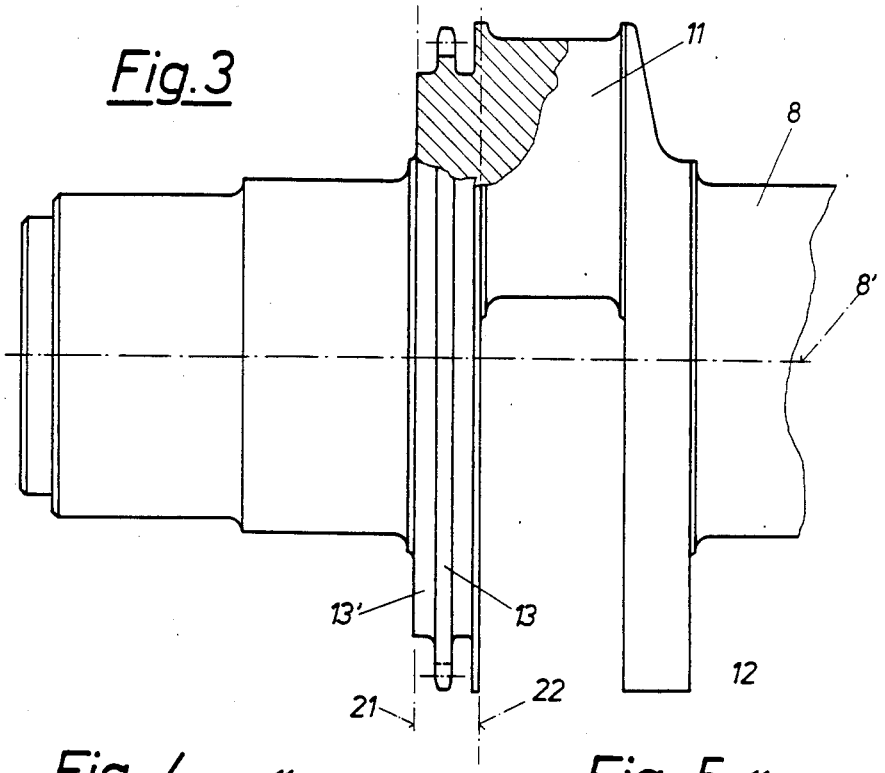
FIG. 3 presents an enlarged detail of the same variant.

The drive of the camshaft 5 is effected from the driving gear 13 on the crankshaft 8 via the intermediate shaft 14, which is provided with a driven gear 15 for this purpose, the driven gear 15 being in contact with the driving gear 13 via a chain 16. In the example presented in the drawing there is a 1:1 transmission ratio between crankshaft and intermediate shaft. Instead of the chain drive other driving mechanisms may be employed, for instance a train of gears or a toothed belt drive. The intermediate shaft 14 carries the driving gear 17 of a toothed belt drive establishing the driving connection to the toothed belt pully 6 on the camshaft 5 via the toothed belt 18. The front boundary 19 of the toothed belt 18 does not extend beyond the front boundary plane 20 of the torsional vibration damper 9. The gear elements driving the intermediate shaft 14, i.e., the driving gear 13, the chain 16 and the driven gear 15, are situated within the boundary planes 21 and 22 running normal to the crankshaft axis 8' (cf. FIG. 3).

On the end facing towards the flywheel 10 the intermediate shaft 14 has a bevel gear 23 meshing with the bevel gear 25 on the shaft 24 and driving both a fuel injection pump 26 and an oil pump 27. In a spark ignition engine a distributor may take the place of the fuel injection pump 26. All of the latter parts are situated in the engine crankcase; the toothed belt drive between intermediate shaft 14 and camshaft 5 is sealed by a cover 28.

The pulley 32 shown in FIG. 2 serves as an idler for the toothed belt 18; in addition, it can be used for driving various accessory units, such as a water pump or a hydraulic pump.

Figure 4:
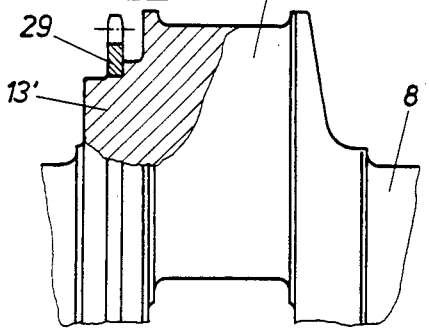
FIGS. 4, 5 and 6 present the same detail as in FIG. 3, but each for another variant.
Figure 5:
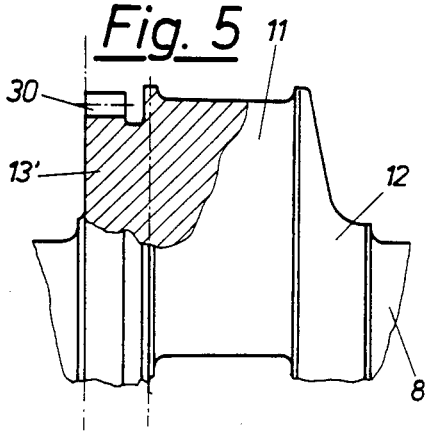
Figure 6:
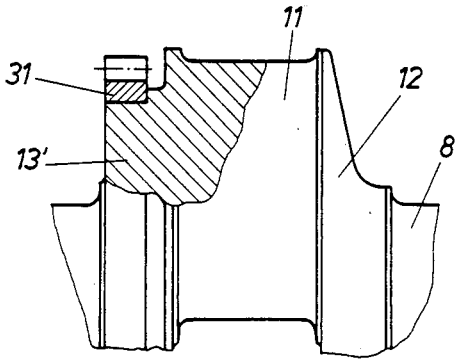

In the variant presented in FIG. 4 the driving gear on the crankshaft 8 is configured as a separate chain gear rim 29 which is rigidly connected, for instance by shrinking, to the crankshaft, or rather its outer cheek 13'. In the variants shown in FIGS. 5 and 6 the driving gears are configured as gear wheels 30 and 31, respectively, i.e., integral with the crank cheek 13' in the variant of FIG. 5, and a separate shrunk-on gear rim 31 in the variant of FIG. 6.

We claim:

1. An internal combustion engine comprising a crankshaft and cylinders arranged in-line, an overhead camshaft for actuating intake and exhaust valves of said combustion engine, said camshaft being driven from said crankshaft by means of a driving gear, wherein said driving gear is placed on an outer cheek of said crankshaft between planes bounding said outer cheek and running normal to the axis of said crankshaft, and wherein said camshaft is driven from an intermediate shaft which for its part is driven via gear elements by said driving gear on said outer cheek of said crankshaft.

2. An internal combustion engine according to claim 1, comprising a torsional vibration damper at one end of said crankshaft and a flywheel on the other end, wherein said camshaft is driven by a toothed belt whose front boundary does not extend beyond the front boundary plane of said vibration damper, and wherein said gear elements driving said intermediate shaft are located within said planes bounding said outer cheek of said crankshaft on the side of said torsional vibration damper.

3. An internal combustion engine according to claim 1, wherein said driving gear and said outer cheek of said crankshaft are a one-piece unit.

4. An internal combustion engine according to claim 2, wherein said driving gear and said outer cheek of said crankshaft are a one-piece unit.

5. An internal combustion engine according to claim 1, wherein said driving gear is a separate part which is rigidly connected to said outer cheek of said crankshaft.

6. An internal combustion engine according to claim 2, wherein said driving gear is a separate part which is rigidly connected to said outer cheek of said crankshaft.

7. An internal combustion engine according to claim 5, wherein said driving gear is rigidly connected to said outer cheek of said crankshaft by shrinking.

8. An internal combustion engine which comprises a cylinder block which has a front end and a rear end, said cylinder block including a plurality of aligned cylinders having pistons therein, each of said cylinders including intake and exhaust valves, a crankshaft which has a front end and a rear end and which includes a plurality of pairs of cheeks and a crankpin connected between each of said pairs of cheeks, each crankpin being connected to a respective piston, each pair of cheeks located nearest both the front end of said crankshaft and the rear end of said crankshaft having an outer cheek, each said outer cheek extending perpendicularly to said crankshaft and having opposite forward and rearward sides that define front and rear planes that extend perpendicularly to said crankshaft, one of said outer cheeks carrying a first driving gear, said first driving gear being between the front and rear planes defined by said one outer cheek, an intermediate shaft mounted in alignment with said crankshaft, said intermediate shaft including a first driven gear and a second driving gear thereon, and first driving means connected between said first driving gear and said first driven gear, a cylinder head mounted on said cylinder block, said cylinder head including a camshaft for actuating said intake and exhaust valves of each of said plurality of cylinders, said camshaft including a second driven gear thereon, and second driving means connected between said second driving gear and said second driven gear so that rotation of said intermediate shaft via said first driving means will cause said camshaft to rotate via said second driving means.

9. An internal combustion engine according to claim 8, wherein said crankshaft mounts a torsional vibration damper at a front end thereof and a flywheel at the rear end thereof, said torsional vibration damper having a flat surface at its front end which defines a first front boundary plane that is perpendicular to said crankshaft; wherein said second driving means is a toothed belt which defines a second front boundary plane, said second front boundary plane being located rearwardly of said first front boundary plane and wherein said first driven gear and said first driving means are located within said front and rear planes of said one outer cheek.

10. An internal combustion engine according to claim 9, wherein said first driving means comprises a chain and said second driven gear comprises a toothed pulley.

* * * * *